US006148810A

United States Patent [19]

Hepworth

[11] Patent Number: 6,148,810

[45] Date of Patent: Nov. 21, 2000

[54] CUTTING/BREAKING APPARATUS

[75] Inventor: Paul Steabben Hepworth, Guildford, United Kingdom

[73] Assignee: Plasplugs Inc., Lakewood, N.J.

[21] Appl. No.: 09/120,413

[22] Filed: Jul. 22, 1998

[30] Foreign Application Priority Data

Sep. 13, 1997 [GB] United Kingdom ..... 9719491

[51] Int. Cl.[7] ..... B28D 1/32

[52] U.S. Cl. ..... 125/23.01; 125/23.02; 225/96.5; 83/886

[58] Field of Search ..... 83/886; 225/96.5; 125/23.01, 23.02

[56] References Cited

U.S. PATENT DOCUMENTS

| | | | |
|---|---|---|---|
| 2,272,160 | 2/1942 | Driver | 125/23.02 |
| 2,568,816 | 9/1951 | Marus | 125/23.02 |
| 4,192,282 | 3/1980 | Fischer | 125/23.02 |
| 5,480,081 | 1/1996 | Wilson et al. | 225/96.5 |
| 5,483,749 | 1/1996 | Hepworth | 125/23.02 X |
| 5,505,359 | 4/1996 | Joecker, Jr. | 225/96.5 |
| 5,560,274 | 10/1996 | Turner | 83/886 |

FOREIGN PATENT DOCUMENTS

| | | |
|---|---|---|
| 608 476 A2 | 8/1994 | European Pat. Off. . |
| 2 189 188 | 10/1987 | United Kingdom . |

*Primary Examiner*—M. Rachuba

*Attorney, Agent, or Firm*—Michaelson & Wallace; Peter L. Michaelson

[57] ABSTRACT

A tile cutter has a base molding of plastic material, which defines a surface for reception of a tile to be cut/broken, and spaced upstanding ends. Cutting/breaking forces applied during use are resisted/absorbed by a steel bar extending between the upstanding ends underneath the tile reception surface. Metallic guide rods extend between the upstanding ends above the tile-reception surface. A steel connecting plate is received in an upstanding end that is located adjacent where tile cutting/breaking takes place. In use, the guide rods carry a scoring and cutting/breaking device that slides on the rods. The connecting plate interconnects the steel bar and the guide rods without using fixing devices. A breaker rod fits in the surface of the base immediately above the position of the steel bar.

11 Claims, 2 Drawing Sheets

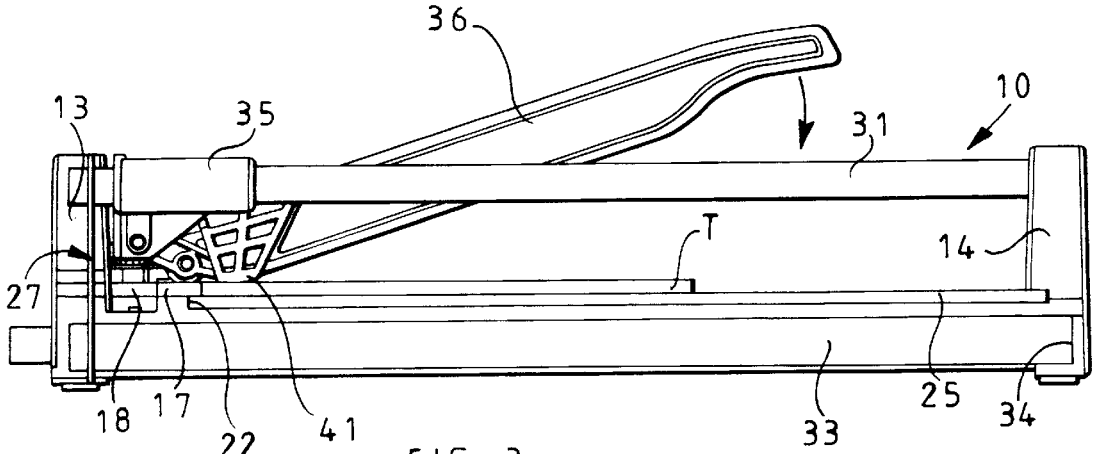
FIG 3
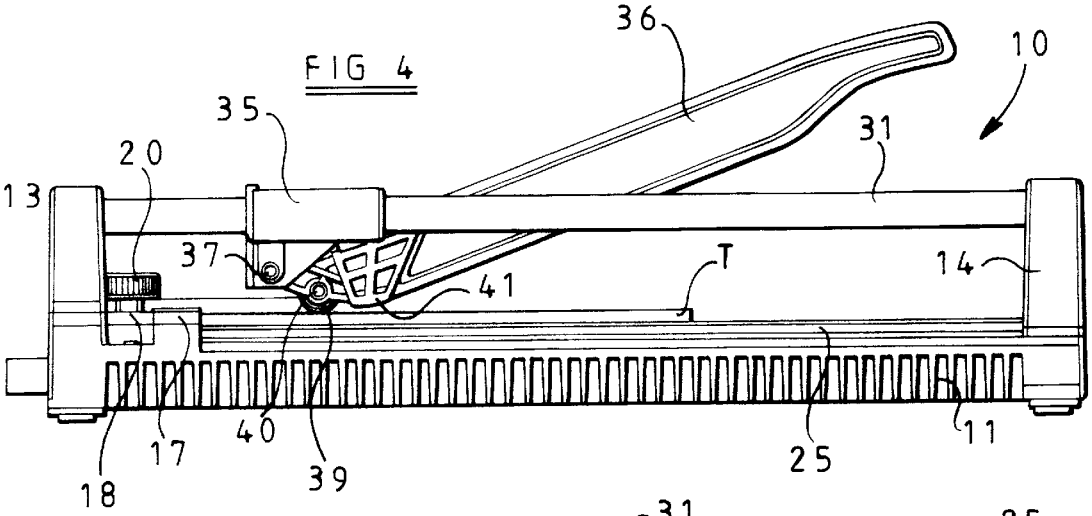
FIG 4
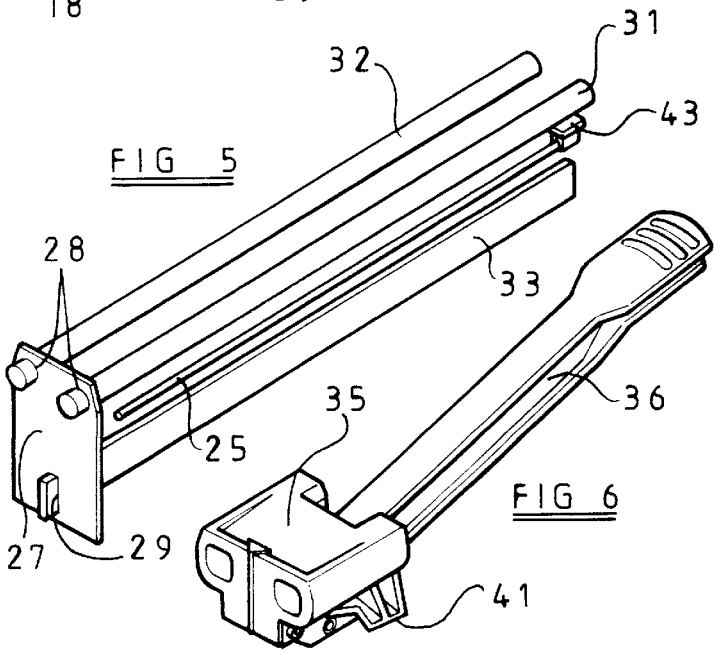
FIG 5
FIG 6
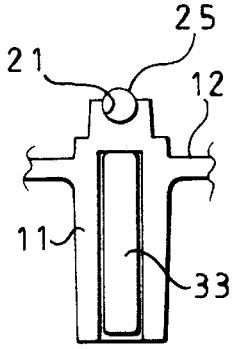
FIG 7

CUTTING/BREAKING APPARATUS

This invention relates to apparatus for cutting/breaking tiles and similar items (hereinafter referred to as a 'tile'), particularly apparatus which includes measuring means and scoring means for correctly 'sizing' a tile prior to cutting/breaking.

With apparatus of this kind, it is essential that the large forces involved in the cutting/breaking process are satisfactorily and properly absorbed without any deformation of the apparatus, since should such deformation occur, there is a tendency for the tile to break laterally, i.e. at 90° to its score line and thus its intended breaking direction. Whilst with some apparatus of this kind the necessary strength is provided by virtue of either a whole frame of the device or a cutting/breaking base of the device being of metal, such as by die-casting, this can result in the apparatus being relatively expensive.

According to the invention there is provided apparatus for cutting/breaking tiles, comprising a base having a surface for reception of a tile to cut/broken, the base having first and second relatively spaced apart ends, support means and strengthening/further support means spaced from said base surface at respective opposite sides thereof and extending from the first end to the second end of the base, operating means for cutting/breaking said tile, the operating means being carried by said support means and being actuatable to effect said cutting/breaking, in use, and connecting means at one of said ends of the base interconnecting the support means and the strengthening/further support means, each of the connecting means, support means and strengthening/further support means being of material which is more rigid than the material of the base, such that forces arising, in use, during the cutting/breaking operation are resisted/absorbed thereby.

The invention will now be described, by way of example, with reference to the accompanying drawings, in which.

Figure 1:
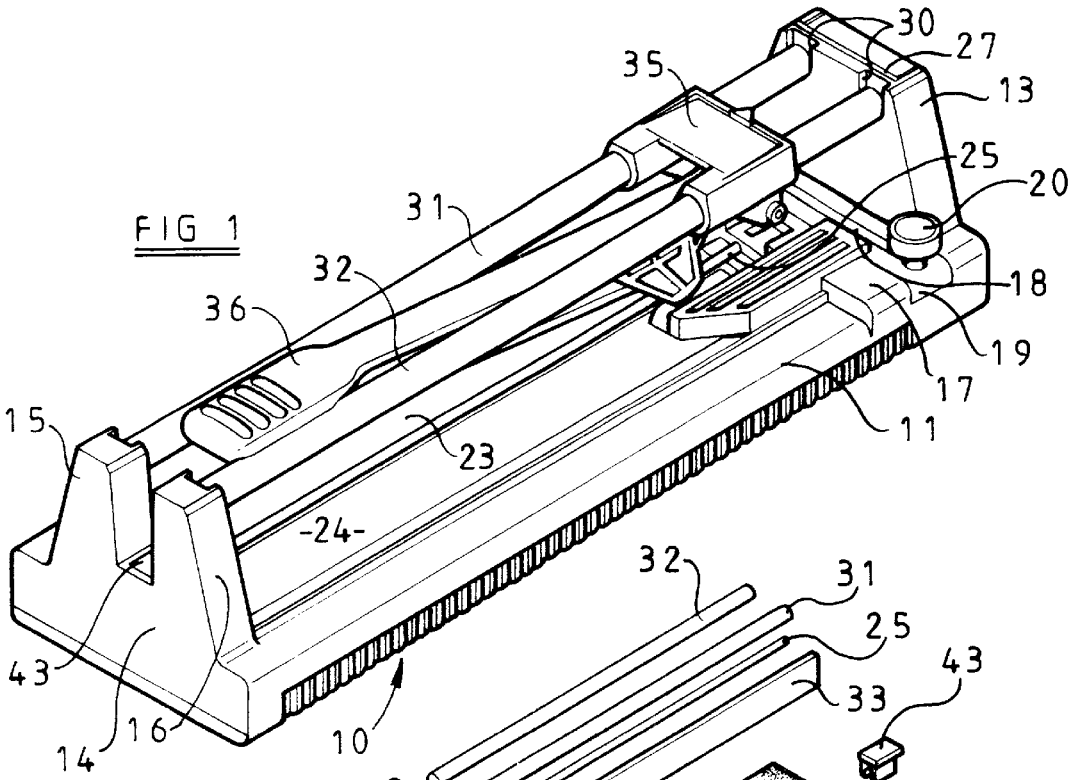
FIG. 1 is a perspective view of apparatus of the present invention.

FIG. 3 is a part-internal side view of the apparatus of FIG. 1, in one state of use, FIG. 4 is a side view of the apparatus of FIG. 1, in another state of use, FIG. 5 is a perspective view of parts of the apparatus of the present invention for resisting/absorbing breaking forces and breaking a tile, respectively, FIG. 6 is a perspective view of a further part of the apparatus, and FIG. 7 is an enlarged schematic scrap sectional view through the apparatus of FIG. 1 showing relationship between a breaker bar and a strengthening/support bar.

Apparatus of the present invention shown in FIG. 1 is intended primarily for the cutting/breaking of tiles, but can also be used for the cutting/breaking of similar items, namely those of the same type of plate-like form, or items having a planar body. As used hereinafter, the term 'tile' is thus to be interpreted as including all such similar items.

The tile cutter 10 shown in the drawings is formed by a main base moulding 11 of plastics material. The moulding 11 is of generally rectangular shape in plan and also in lateral cross-section. The moulding has an upwardly facing surface 12 which extends between two upright end columns 13, 14 respectively which are normal to the surface 12 and extend vertically, in use. The moulding 11 is formed in one-part, so that the end columns are integrally formed with the remainder of the moulding, and are thus also of the same plastics material. As can be seen from the drawings, the end column 13 which is at the cutting/breaking end of the device is generally unbroken, whilst the column 14 at the opposite end of the device is centrally divided into two pillars 15, 16 respectively. As will be described, a recess is provided at the junction between these two pillars.

Figure 2:
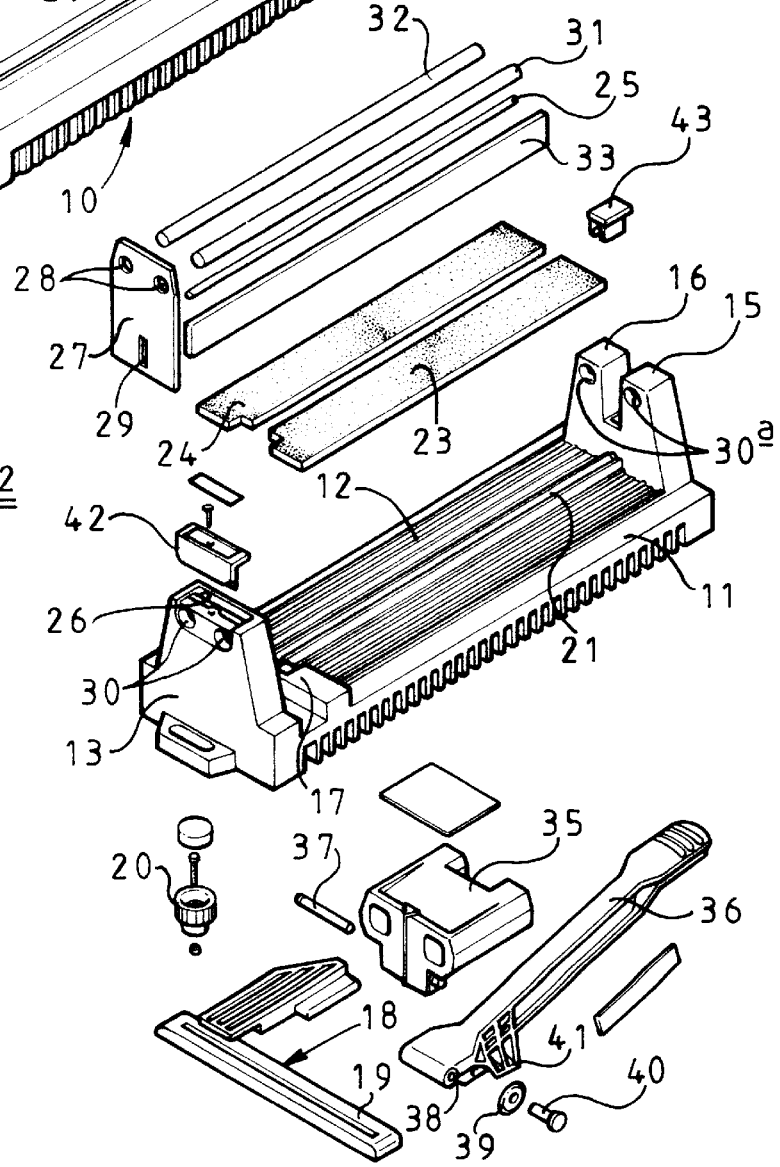
FIG. 2 is a reduced scale exploded view of the apparatus of FIG. 1.

The surface 12 extends from the column 14 towards the column 13, but terminates short thereof at an upstanding projection 17 which extends integrally laterally of the base moulding to define a location for a side stop guide 18 which includes a laterally extending slotted member 19 which fits behind the projection 17 and against the end column 13. Associated with this member 19 is a guide clamp knob 20, through which extends a guide knob bolt which is received in a guide knob nut at the underside of the slot. Thus by tightening or loosening the knob, adjustment of the guide can be effected. The function of the stop guide 18 is conventional, in being essentially of the same form as with known tile cutters where adjustment is possible to cut/break a tile to a specific size/shape, and will not be described further since it forms no part of the present invention. As shown in FIGS. 2 and 7, at the longitudinal centre of the surface 12 there is formed a groove 21 which can extend slightly above the surface. This groove 21 extends into the column 14 at its one end, and into a socket 22 in projection 17 at its other end. Secured to the surface 12 at opposite sides of the groove are respective foam sheets 23, 24 which have their respective outer surfaces substantially flush with the outer surface of the groove 21 so as to provide a base surface for reception of a tile to be cut/broken, in use, as will be described hereinafter. Received in the groove 21, with its ends extending into the column 14 and socket 22 respectively, is a metallic circular-section breaker rod 25.

The end column 13 has a slot therein, this slot 26 extending inwardly from the underside of the column 13 and, in the example shown, extending completely through to the top of the column, although it could terminate short thereof. The slot 26 extends parallel to the, themselves parallel, inner and outer faces of the column, so that, in use, the slot extends vertically. Received in this slot is a generally rectangular steel end plate 27 which forms connecting means, and also strengthening means for the tile cutter, as will be described. As shown best in FIGS. 2 and 6, the plate 27 has a pair of laterally spaced circular holes 28 at its upper end and, at its lower end, a central rectangular hole 29. The upper end of the column 13 has pairs of corresponding circular holes or slots 30 in its inner and outer faces at opposite sides of the slot 26 so that with the plate received in the slot 26, a pair of circular through-bores are formed at the upper end of this column 13. Moreover at the lower end of the column 13, below the level of the base surface, the rectangular hole 29 is exposed, for a purpose to be described.

As shown in FIG. 1, the respective upper ends of the pillars 15, 16 respectively are provided with circular section bores 30*a* therein, these being aligned with the circular bores referred to at the column 13. In the assembled form of the tile cutter 10 shown in FIG. 1, it can be seen that a pair of circular section steel guide rods 31, 32 respectively have their ends fitted in the bores in the column 13 and the holes in the column 14 respectively, so that the rods are held between the two end columns of the tile cutter and extend over the parts of the base surface formed by the foam sheets at opposite sides of the groove 21.

At the underside of the main base moulding 11, there is a rectangular section iron or steel bar 33 arranged with its longer sides vertical, one end of the bar 33 being received through the rectangular hole 29 in the end plate 27, its opposite end being received in an end pocket 34 (FIG. 3) of the moulding. This bar engages the underside of the moulding at a position directly below the breaker rod 25, FIG. 7, and thus forms both strengthening and also support means of the cutter 10 as will be explained more clearly hereinafter, the bar 33, like the guide rods 31, 32, extending between the opposite end columns of the cutter.

It will be appreciated that the plate 27 acts as connecting means to interlock the metallic guide rods and the metallic steel bars without the use of welding, riveting etc. This constitutes a very convenient and effective way of resisting/absorbing the large forces generated when a tile is broken, bearing in mind that the main moulding 11 is of plastics material. In this manner a relatively inexpensive base moulding can be used, thus enabling the overall cost of the cutter to be reduced as compared with known prior art devices where the base is metallic. Carried on the guide rods is a slider moulding 35 to which is centrally pivotally mounted an operating lever handle 36, the pivotal mounting being by way of a lever pin 37 which extends through the moulding and also through a circular bore 38 at the end of the handle 36. The assembly of moulding 35 and handle 36 is shown in FIG. 6, whilst FIGS. 2 and 4 show how a carbide cutting wheel 39 is, by use of a wheel axle pin 40, attached to the handle 36 at the underside thereof in front of a pair of laterally spaced wings 41 extending integrally downwards from the underside of the handle to effect breaking of a tile, as will be described when the handle is pivotally fully downwardly as shown in FIG. 3.

Finally to complete the description of the cutter as shown in the Figures, reference is made to a tube retainer moulding 42 which is shown in FIG. 2 and which can be screwed into place on top of the end column 13 to secure the guide rods against removal, this at the same time thereby preventing removal/disengagement of the plate 27 and bar 33. As can be seen, the moulding 42 is of right-angle form having a downwardly depending part which is received in a recess at the top of the outwardly facing surface of the column 13, and a forwardly projecting part which fits across the top of the column 13 and through which the fixing screw is received. FIG. 2 also shows a lock plug 43 which is in the form of a snap-in retainer which is received in the recess between the pillars 15, 16, and snap-fits or clips over the end of the breaker rod 25. For clarity this plug 43 is not shown in FIG. 3, but is, for example, shown on the end of the rod in FIG. 5.

Having described the structure of the tile cutter, assembly and use thereof will now be described.

Firstly it will be mentioned that assembly will only be explained in relation to the parts of the tile cutter which form part of the present invention and thus, for example, there will be no description of the assembly or use of the side stop guide 18, nor of the assembly of the moulding 35, operating lever handle 36 and associated cutting wheel 39.

The invention relates generally to the manner in which the large forces produced during breaking of a tile are taken by the interlocking metallic parts described, without the use of welding, riveting etc. The main base moulding is reinforced by the iron or steel bar 33. At the handle end, this bar is supported by the plastics moulding because the forces here are low. At the breaking end, however, the forces are taken by the plate 27 which links the bar 33 to the two top metallic guide rods. A downward braking force exerted on a tile is received onto the central breaker rod 25 which sits in its groove in the moulding and is supported directly underneath by the steel bar 33, as shown in FIG. 7. In the embodiment illustrated, the breaking can only be carried out at the breaking end where the carbide cutting wheel 39 clears the tile surface, allowing the breaking wings 41 to contact the tile surface. The breaking action here tends to force the guide rods upwardly and the tile cutter bed downwardly, and it is the method of interlocked metallic parts which takes the forces.

Firstly on assembly, the bar 33 is inserted into the end pocket 34 formed in the moulding at the bottom of the end column 14, the bar at this time being orientated at an angle to the base surface. The other end of the bar can then be inserted through its associated rectangular hole 29 in the end plate 27 and the two parts can then be swung upwardly so as to move fully into the position shown in FIG. 3, with the plate vertical and the bar horizontal, its end at the plate 27 being received at the bottom of the upright 13. In this position, with the plate fully received in the upright end column 13, the circular holes 28 in the plate 27 are aligned with the other holes in the end column 13 to form two respective throughbores, as previously described. Accordingly it is possible for the guide rods 31, 32, now to be fed into position through these bores through the end column 13, the rods also of course passing through the holes in the end plate 27. The rods are inserted at this time through the slider moulding, and then into the holes 30*a* respectively in the pillars 15, 16 of the end column 14. The interconnection between the guide rods 31, 32 and the bar 33 by way of the end plate 27 is now complete and the tube retaining moulding 42 can now be screwed into place at the top of the column 30 to retain the three metal, preferably steel, components in place. As described, the closing of the outward ends of the through bores in the end column 13 prevents the guide rods being moved outwardly in a direction opposite to their direction of insertion, and as a result these three metallic components are now securely interlocked to strengthen the moulding and to provide support, by way of the bar 33, for the breaker rod 25.

The breaker rod itself is assembled into its groove 21 by first inserting it into the extension of the groove 21 into the end column 14 shown best in FIG. 2. This insertion is for approximately 25 mm (1 inch). The rod can then be slid in the opposite direction towards the breaker end of the cutter and fed a short way into the socket 22. The rod is then retained in place by the lock plug 43 which, as shown in FIG. 5, clips over the rod end and, as shown best in FIG. 1, fits flush in the recess between the two pillars 15 and 16. The rod provides an accurate and desirable hard edge to break the tiles over. It does not however provide strength and could, if required, be replaced, reduced or omitted. Accordingly in use after a tile T has been correctly and accurately located on the upwardly facing surface of the cutter defined by the foam sheets 23, 24 and the top of the groove 21, the handle 36 in its FIG. 4 state can be reciprocated with the cutting wheel in contact with the tile so as to score the tile at the position at which it is to be cut, in the normal manner.

After scoring the tile, the handle and slider moulding are moved to the position shown in FIG. 3 where, as previously mentioned, the cutting wheel is now clear of the tile surface. Accordingly on pivoting the handle downwardly, the braking wings 41 contact the tile surface, as shown in FIG. 3, whereupon continued downward pressure will lead to the tile breaking clearly along its score line, with, as also mentioned, the breaker rod providing the desired hard edge over which the tile breaks. It will be noted that, as previously mentioned, without sufficient strengthening/reinforcement to absorb the braking forces, the tile would instead tend to break laterally.

In alternative embodiments, it would be possible to provide only a single guide rod rather than the pair of guide rods shown. Moreover instead of providing the interlocking plate 27 at one end of the cutter, such plate or equivalent could be provided at the opposite end only or at both ends. It will be appreciated that metal plates are likely to be required at both ends should an alternative embodiment be such that breaking can take place other than with the carbide cutting wheel at an end of the cutter. For example some arrangement may be possible where the wings are pivotable, and with such an arrangement breaking may take place by the pivoting downwards of the wings onto the tile with the resultant lifting off the tile of the cutting wheel. Since this could take place other than with the handle in a position shown in FIG. 3, plates may be required at both ends as described. Although preferably the plate 27, guide rods 31, 32 and bar 33 are all of iron or steel, any other suitable metal or higher strength material could be used, such as carbon fibre. It is merely necessary that with these components they are made of respective materials which are more rigid/stronger than the material of the base. As explained by utilising as much plastics material as possible the cost of the cutter can be reduced. Clearly the plate 27, the guide rods 31, 32 and the steel bar 33 need not all be made of the same material.

What is claimed is:

1. A tile cutter comprising:

a non-rigid base having spaced first and second end pieces, and a broad, tile-receiving surface located between said end pieces, and wherein said first end piece includes a member upstanding from said tile-receiving surface, and said member has an inner surface in which a first bore is provided;

a first support, having substantial rigidity, spaced above said tile-receiving surface between said first and second end pieces, said first support having a first end;

a second, elongated support, having substantial rigidity, extending between said first and second end pieces below a mid-section of said tile-receiving surface;

cut-and-break means mounted on said first support for cutting and/or breaking a tile resting on said mid-section in response to activation of said cut-and-break means; and connecting means, including a plate located in said member and having substantial rigidity with first and second openings therein to receive a first end of each of said first and second supports, respectively, for rigidly interconnecting said first and second supports such that reaction forces generated during said activation of said cut-and-break means include a set of reaction forces exerted substantially by said cut-and-break means, said first and second supports, and said connecting means, while said non-rigid base exerts a separate reaction force substantially less than each of said reaction forces in said set, wherein said first bore is aligned with said first opening in the plate to receive said first end of the first support, and said first end of said first support extends through said first bore into said first opening in said plate.

2. The tile cutter of claim 1, wherein said member has an outer surface in which a further bore is provided, said further bore being aligned with one of said openings in the plate and there being retaining means fitted to said member to prevent passage of said first support through said further bore in a direction away from said second end piece of the base.

3. The tile cutter of claim 1, wherein said first end of said second support extends through said second opening in said plate, said second support has a second end, said second end piece of said base has a pocket, and said second end of said second support mounts in said pocket in said base.

4. The tile cutter of claim 1, wherein said first support comprises two guide rods, having substantial rigidity, along which said cut-and-break means can slide.

5. The tile cutter of claim 4, wherein said guide rods are of metallic material.

6. The tile cutter of claim 3, wherein said second support includes an elongated beam having a broad rectangular face and an elongated edge.

7. The tile cutter of claim 6, wherein said beam mounts with said broad rectangular face in a plane substantially perpendicular to said tile-receiving surface and with said narrow elongated edge engaging an undersurface of said base below said mid-section.

8. The tile cutter of claim 7, wherein a breaker bar is disposed at said tile-supporting surface at a position directly over said elongated edge of said beam.

9. The tile cutter of claim 8, wherein said beam is of metallic material.

10. The tile cutter of claim 1, wherein the base is of plastics material.

11. The tile cutter of claim 1, wherein the first support, said second support, and the connecting means are of iron or steel.

* * * * *